US005813275A

United States Patent [19]

Kawakami et al.

[11] Patent Number: 5,813,275

[45] Date of Patent: Sep. 29, 1998

[54] SAFETY CIRCUIT FOR PRESS DIE CUSHION

[75] Inventors: Yasuo Kawakami; Masami Suzuki, both of Komatsu, Japan

[73] Assignee: Komatsu Ltd., Tokyo, Japan

[21] Appl. No.: 765,386

[22] PCT Filed: Jul. 4, 1995

[86] PCT No.: PCT/JP95/01336

§ 371 Date: Dec. 17, 1996

§ 102(e) Date: Dec. 17, 1996

[87] PCT Pub. No.: WO96/01159

PCT Pub. Date: Jan. 18, 1996

[30] Foreign Application Priority Data

Jul. 5, 1994 [JP] Japan ..... 6-153396

[51] Int. Cl.[6] ..... B21D 24/08

[52] U.S. Cl. ..... 72/453.13; 100/259; 267/119

[58] Field of Search ..... 72/351, 453.13; 100/259; 267/119

[56] References Cited

U.S. PATENT DOCUMENTS

| | | | |
|---|---|---|---|
| 4,635,466 | 1/1987 | Seki et al. | 72/453.13 |
| 5,295,383 | 3/1994 | Kirii et al. | 72/453.13 |
| 5,299,444 | 4/1994 | Kirii et al. | 72/453.13 |
| 5,457,980 | 10/1995 | Kirii et al. | 72/453.13 |

FOREIGN PATENT DOCUMENTS

| | | | |
|---|---|---|---|
| 0227349 | 9/1985 | Germany | 72/453.13 |
| 52-23107 | 6/1977 | Japan . | |
| 0097819 | 7/1980 | Japan | 72/453.13 |
| 56-109200 | 8/1981 | Japan . | |
| 58-70998 | 4/1983 | Japan . | |
| 58-70999 | 4/1983 | Japan . | |
| 61-14026 | 1/1986 | Japan | 72/453.13 |
| 4-98318 | 8/1992 | Japan . | |
| 5-254 | 1/1993 | Japan . | |
| 5-39798 | 5/1993 | Japan . | |

*Primary Examiner*—David Jones

*Attorney, Agent, or Firm*—Frishauf, Holtz, Goodman, Langer & Chick

[57] ABSTRACT

A safety circuit for a press die cushion wherein the press die cushion has a pad that is resiliently supported by a cushion cylinder which is supplied with a pilot pressure via an air delivery circuit, and wherein the press die cushion has a locking circuit for locking the pad. The safety circuit includes a first electromagnetic valve which is electrically switchable in two directions for controlling delivery of the pilot pressure to an air supply valve in the air delivery circuit to the cushion cylinder, and for controlling the air supply valve in order to lift the pad up and down. An on and off valve is disposed in a pilot pressure delivery passage of the air delivery circuit, and is opened when the pad lies in a vicinity of a lower limit position. A second electromagnetic valve is connected to the on and off valve. The second electromagnetic valve is electrically switchable in a first direction to a blocking position when a power supply is turned on, and is mechanically switchable thereafter to a communicating position when the power supply is turned off. An exhaust valve is provided in the air delivery circuit. The exhaust valve is switched into an exhaust position when the pilot pressure is applied via the on and off valve and the second electromagnetic valve, and is switched into a blocking position when the pilot pressure is absent.

9 Claims, 6 Drawing Sheets

SAFETY CIRCUIT FOR PRESS DIE CUSHION

TECHNICAL FIELD

The present invention relates to a safety circuit for a press die cushion arrangement whereby a pad is prevented from being lifted up and down unintentionally.

BACKGROUND ART

Conventionally, a press machine for performing a draw forming operation has customarily been equipped with a die cushion arrangement.

A die cushion in the prior art comprises a pad that is adapted to support a plurality of cushion pins from a downward side and a cushion cylinder that comprises an air cylinder which is adapted to support the said pad resiliently. And, in combination within a locking cylinder that comprises a hydraulic cylinder in place of an air cylinder, a die cushion arrangement that is capable of temporarily locking the pad and hence having a locking function has hitherto be employed. Such a die cushion arrangement has been disclosed, for example, in Japanese Examined Patent Publication No. Sho 52-23107, Japanese Unexamined Patent Publication No. Sho 58-70998, Japanese Unexamined Patent Publication No. Sho 58-70999 and Japanese Examined Utility Model Publication No. Hei 5-254.

A known, a circuit for a die cushion having a locking function for a pad is illustrated in FIGS. 1 and 2.

More specifically, each of the both circuits comprises a pressure conditioning circuit a for adjusting a plant air to a specified pressure and supplying the adjusted air to an air reservoir b, an air reservoir circuit e for compensating for a change in the air pressure within each of a pair of cushion cylinders d when the pad c is cushion operated, an air supply valve 1 interposed between the air reservoir b and the cushion cylinders d for operating an upward movement and a downward movement of each of the cushion cylinders d, one or a plurality of electromagnetic valve f for establishing and blocking a supply of a pilot pressure to the air supply valve 1, a regulator g for conditioning the said pilot pressure, a manually operated pressure conditioning circuit h for substituting for the above mentioned pressure conditioning circuit a when the latter fails, a locking cylinder i for locking the pad c and a locking circuit j therefor.

And, in a circuit shown in FIG. 1 the electromagnetic valve f may comprise the "both SOL" (both side solenoid) type in which the value may be switched electrically in both directions, whereas in a circuit shown in FIG. 2 the electromagnetic valve f may comprise the "one side SOL" (one side solenoid) type in which the value may be electrically switched in a single direction and thereafter returned to its neutral position by a spring in the other direction.

In a circuit in which the electromagnetic valve f makes use of a "both side SOL" as shown in FIG. 1, if the power supply is turned OFF due to an emergency stop or the like during a pressing operation, the electromagnetic valve f remains at the position in which it had been so that the pad c lying at its upper limit position or the pad c lying at its lower limit position may not be unintentionally lifted downwards or upwards; hence t he system is safe.

However, it has recently become customary for the purpose of an energy saving to turn the plant air source OFF while the press machine ceases performing its pressing operation.

For this reason, the pad c that has been at its upper limit position at the end of a pressing operation may slowly descend according to a pressure drop due to a fluid leakage in the cushion cylinder d or in its circuit to come to a stop at its lower limit position. Accordingly, there has always been the problem that when the plant air source is turned ON to initiate a pressing operation the next day, contrary to the operator's intent the pad c may be suddenly lifted upwards to the extent that if the operator is present in the press machine, he or she will be exposed to danger.

Also, if the press machine is a suction operated workpiece conveyance transfer press in which a workpiece is attracted in a state where the pad is locked, turning the power supply OFF in situ when the press machine is emergency stopped due to a failure in the workpiece attraction or the like will cause a fluid leakage in the locking cylinder i or in the locking valve k to raise the pad c and consequently to raise a portion of the lower die along with a product. As a result, there is brought about the problem that the product may collide with the suction operated workpiece attracting cap or a cross bar, thereby resulting in damage.

For this reason, a suction operated workpiece conveyance transfer press makes use of a said one side SOL type electromagnetic valve f as shown in FIG. 2 and employs a circuit which is adapted to lower the pad c in a situation as mentioned above.

However, in a circuit in which such a one side SOL type electromagnetic valve f is used, during a pressing operation or if a power failure or an interruption of service occurs when the pad c is at its upper limit position or if the power supply is turned OFF as a result of the termination of a pressing operation, it occurs that the electromagnetic valve f is returned under the action of a spring. As a consequence, there develops the problem that air may be discharged out of the cushion cylinders to lower the pad c unintentionally and an operator, if present in the press machine, may then be thrown out.

The present invention has been made in order to obviate the problems mentioned above and has as its object to provide a safety circuit for a press die cushion which is capable of preventing a pad from being lifted up or down contrary to the operator's intention.

SUMMARY OF THE INVENTION

In order to achieve the object mentioned above, there is provided in accordance with the present invention, in a first general form of embodiment thereof, a safety circuit for a press die cushion having a pad that is resiliently supported by a cushion cylinder and a locking circuit for locking the pad, the safety circuit comprising: a first electromagnetic valve of both side solenoid type for controlling a delivery of a pilot pressure to an air supply valve in an air delivery circuit to the said cushion cylinder and controlling the said air supply valve in order to lift said pad up and down; an on and off valve that is disposed in a pilot pressure delivery passage and is adapted to be opened when the said pad lies in the vicinity of its lower limit position; a second electromagnetic valve of one side solenoid type that is connected to the said on and off valve and that is adapted to be blocked when a power supply is turned on and that is adapted to be brought into a communicating state when the said power supply is turned off; and an exhaust valve that is connected to the said air delivery circuit and that is adapted to be switched into an exhaust side under a pilot pressure applied via the said on and off valve and the said second electromagnetic valve and that is adapted to be switched into a blocking side in the absence of a said pilot pressure.

The present invention also provides, in a second general form of embodiment thereof, a safety circuit for a press die cushion having a pad that is resiliently supported by a cushion cylinder, the safety circuit comprising: a first electromagnetic valve of both side SOL type for controlling a delivery of a pilot pressure to an air supply valve in an air delivery circuit to said cushion cylinder and controlling the said air supply valve in order to lift the said pad up and down; an on and off valve that is disposed in a pilot pressure delivery passage and is adapted to be opened when said pad lies in the vicinity of its lower limit position; a second electromagnetic valve of one side SOL type that is connected to the said on and off valve and that is adapted to be blocked when a power supply is turned on and that is adapted to be brought into a communicating state when the said power supply is turned off; and an exhaust valve that is connected to the said air delivery circuit and that is adapted to be switched into an exhaust side under a pilot pressure applied via the said on and off valve and the said second electromagnetic valve and that is adapted to be switched into a blocking side in the absence of a said pilot pressure.

The present invention also provides, in a third general form of embodiment thereof, a safety circuit for a press die cushion having a pad that is resiliently supported by a cushion cylinder and a locking circuit for locking the pad, the safety circuit comprising: a first electromagnetic valve of both side SOL type for controlling a delivery of a pilot pressure to an air supply valve in an air delivery circuit to the said cushion cylinder and controlling the said air supply valve in order to lift the said pad up and down; a second electromagnetic valve of one side SOL type that is adapted to be blocked when a power supply is turned on and that is adapted to be brought into a communicating state when the said power supply is turned off; and an exhaust valve that is connected to the said air delivery circuit and that is adapted to be switched into an exhaust side under a pilot pressure applied via the said on and off valve and the said second electromagnetic valve and that is adapted to be switched into a blocking side in the absence of a said pilot pressure, an upstream side of the said locking circuit and an upstream side of the said second electromagnetic valve being connected together by a conduit line having a check valve in its midway.

The present invention also provides, in a fourth general form of embodiment, a safety circuit for a press die cushion having a pad that is resiliently supported by a cushion cylinder and a locking circuit for locking the pad, the safety circuit comprising: a first electromagnetic valve of both side SOL type for controlling a delivery of a pilot pressure to an air supply valve in an air delivery circuit to the said cushion cylinder and controlling the said air supply valve in order to lift the said pad up and down; an on and off valve that is disposed in a pilot pressure delivery passage and is adapted to be opened when the said pad lies in the vicinity of its lower limit position; a second electromagnetic valve of one side SOL type that is connected to the said on and off valve and that is adapted to be blocked when a power supply is turned on and that is adapted to be brought into a communicating state when the said power supply is turned off; and an exhaust valve that is connected to the said air delivery circuit and that is adapted to be switched into an exhaust side under a pilot pressure applied via the said on and off valve and the said second electromagnetic valve and that is adapted to be switched into a blocking side in the absence of a said pilot pressure, the said locking circuit on the one hand and a junction of the said on and off valve and the said second electromagnetic valve on the other hand being connected together by a conduit line having a check valve midway therealong.

According to each of the constructions mentioned above in which by using the electromagnetic valve of both side SOL type, the pad is made capable of being lifted up and down, it should be noted that if the power supply is turned off due to an occurrence of a power failure or an emergency stop during a pressing operation, the electromagnetic valve is allowed to remain in the state in which it had been and accordingly the pad is effectively prevented from being lifted up or down unintentionally; hence the system is rendered extremely safe.

Also, by virtue of the arrangement in which by providing an on and off valve that is adapted to be mechanically opened when the pad lies in the vicinity of its lower limit position, an electromagnetic valve of one side SOL type that is adapted to be blocked when the power supply is turned on and that is adapted to be brought into a communicating state when the power supply is turned off and an exhaust valve that is adapted to be switched into an exhaust side under a pilot pressure that is supplied via the said on and off valve and the said electromagnetic valve, at the time of a power failure or an emergency stop when the locking effected an air within the cushion cylinder is allowed to be exhausted, it should be noted if the air source is turned on when the locking is effected and when the power supply is on, the pad is effectively prevented from being lifted up and hence the system is rendered safe. Especially, even if the power supply and the air source are turned off at the same time, exhausting air out of the cushion cylinder will cause the pad to be lowered and stopped at its lower limit position and will prevent the pad from being lifted up. Accordingly, damage to a product, a workpiece suction attracting means or a cross bar that would otherwise occur due to the undesirable rise of the pad can be thereby prevented effectively.

It should be noted further at this point that in addition to each of the constructions 1, 2 and 4 mentioned above, an arrangement is desirable in which the said on and off valve is allowed to be opened by a cam means that is provided at a side of the pad.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Figure 1:
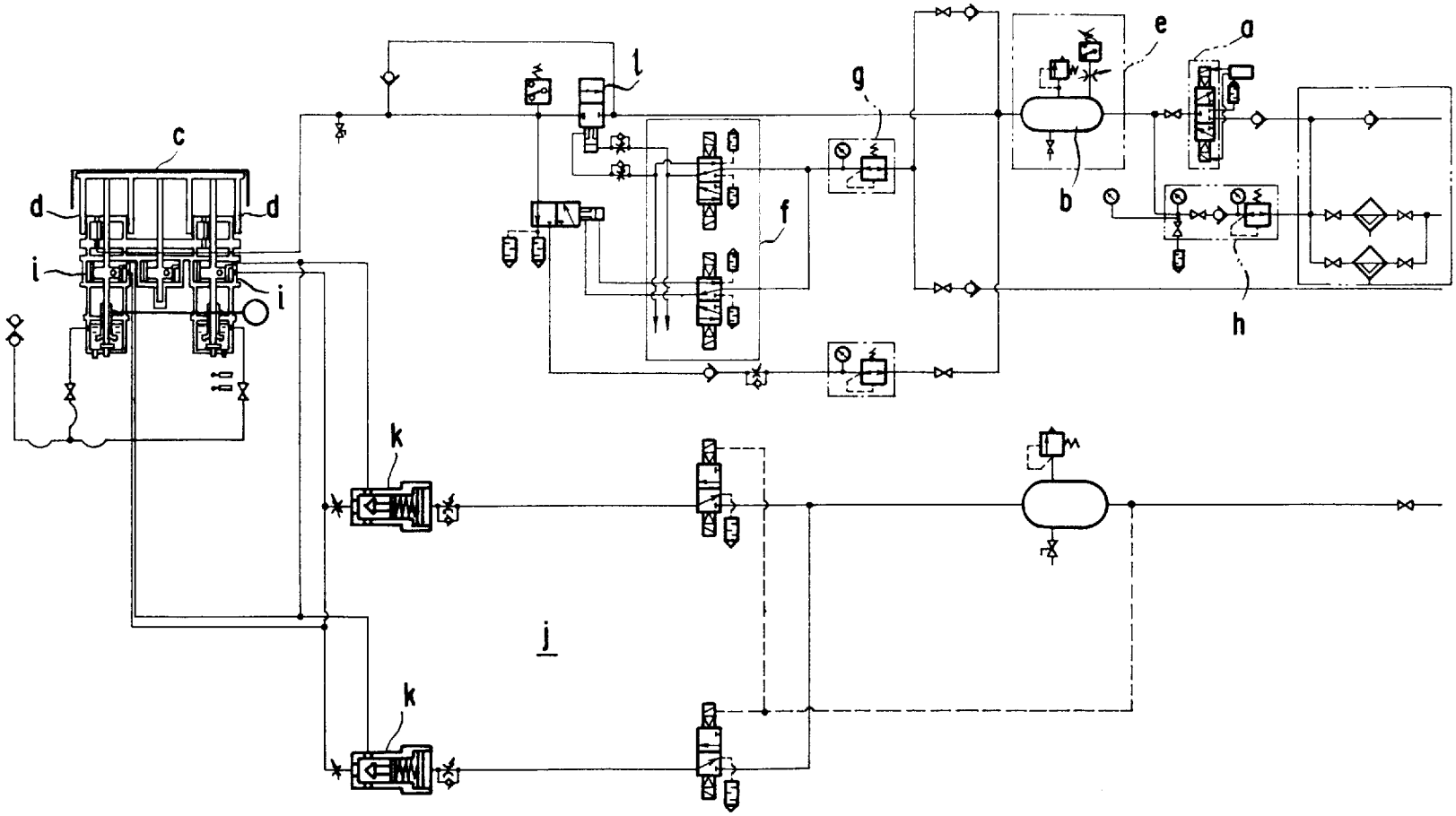
FIG. 1 is a circuit diagram of an example of the press die cushion in the prior art.
Figure 2:
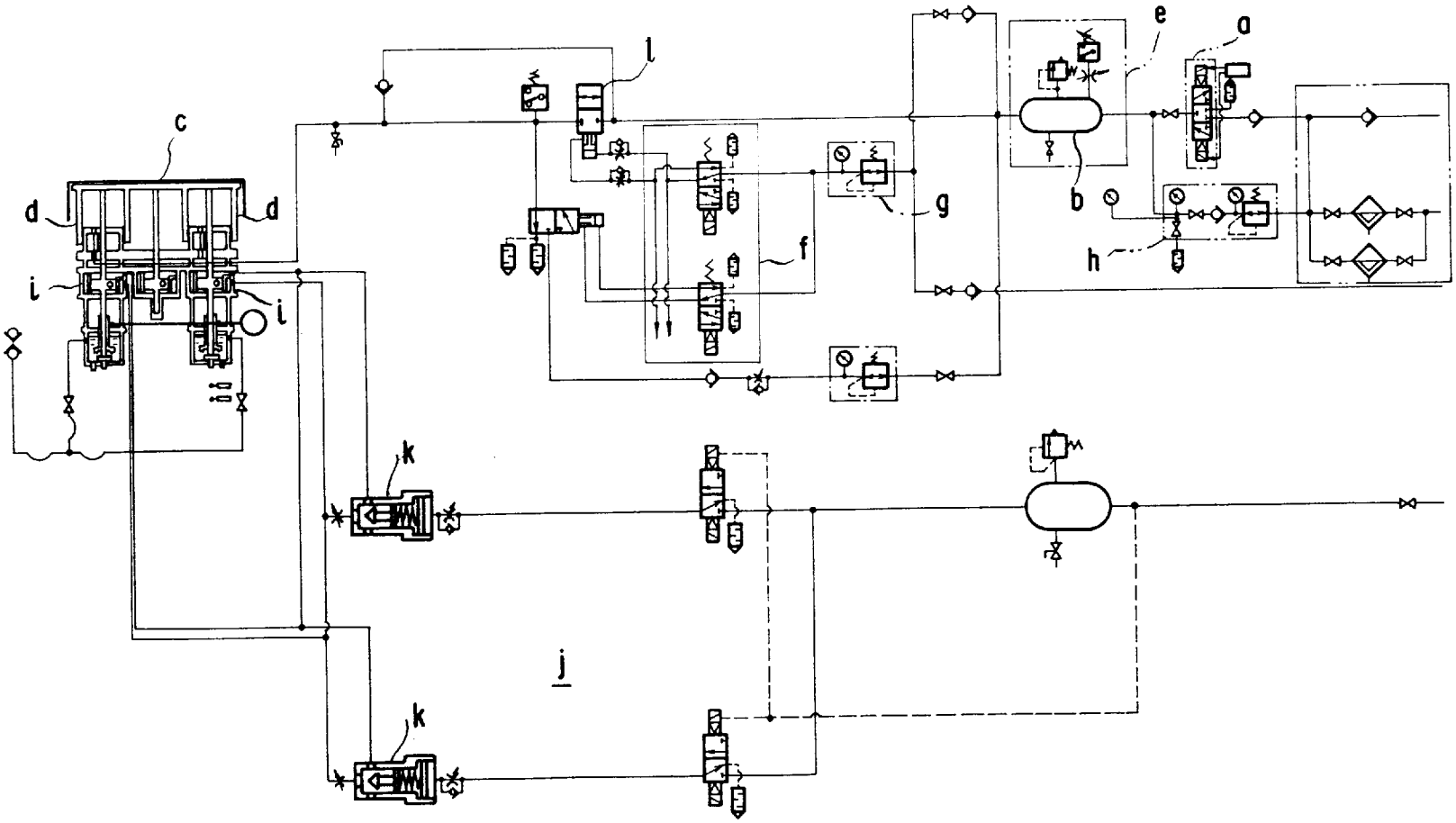
FIG. 2 is a circuit diagram of another example of the press die cushion in the prior art.

Hereinafter, suitable embodiments of the present invention with respect to a safety circuit for a press die cushion will be set forth with reference to the accompanying drawings.

A detailed explanation will now be given of a first embodiment of the present invention with reference to FIG. 3.

Referring to 3, reference numeral 1 designates a pad on which a lower die (not shown) is mounted, reference numerals 2 denote a pair of cushion cylinders, each of which comprises of an air cylinder, for resiliently supporting the pad 1 from its downward side, and reference numerals 3 represent a pair of locking cylinders, each of which comprises of a hydraulic cylinder, for locking the pad 1 in the vicinity of its lower limit position.

Figure 3:
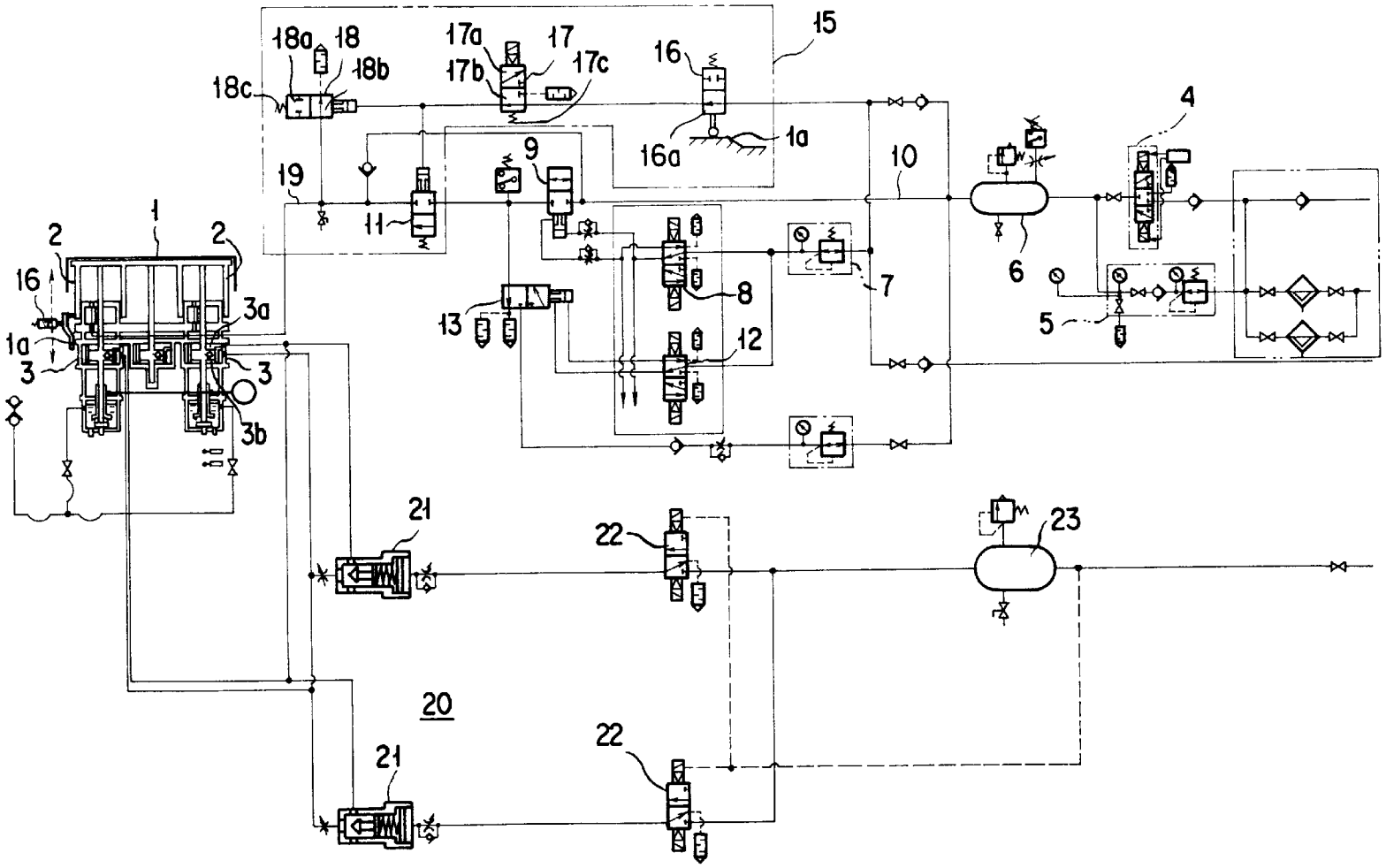
FIG. 3 is a circuit diagram of a first embodiment of the safety circuit for a press die cushion, that is constructed in accordance with the present invention.

Referring further to FIG. 3, reference numeral 4 designates an automatic pressure adjusting circuit element whereas reference numeral 5 denotes a manually operated pressure adjusting circuit element which, when the automatic pressure adjusting circuit element 4 fails, acts to allow a pressure to be manually adjusted and that is connected in parallel to the automatic pressure adjusting circuit element 4. Each of these circuit elements 4 and 5 serves to adjust the pressure of an inlet air, which is then supplied into an air reservoir 6 and thereafter is fed from the air reservoir 6 to a regulator 7 where it is conditioned to develop therefrom a pilot pressure.

And, the said pilot pressure is applied via an electromagnetic valve of both side SOL type to an air supply valve 9, which is adapted to be opened and closed when the said electromagnetic valve 8 is switched over.

Also, the air of the above mentioned air reservoir 6 is passed through a conduit line 10 and is supplied via the above mentioned air supply valve 9 and a blocking valve 11 into the above mentioned cushion cylinders 2 and 2. And, intermediate between the air supply valve and the blocking valve 11 mentioned above, there is connected an exhaust valve 13 that is adapted to be opened and closed under a said pilot pressure which is applied via the said electromagnetic valve 12 of both side SOL type.

On the other hand, reference numeral 15 designates a safety circuit that comprises of an on and off valve 16 which is adapted to be opened, by a cam means 1*a* that is attached to a lower side surface of the above mentioned pad 1, when the latter lies in the vicinity of its lower limit position; an electromagnetic valve 17 of one side SOL type which when electrically energized is adapted to hold its blocking position 17*a* during a pressing operation and is switched over by a spring 17*c* to a communicating position 17*b* when the pressing operation is terminated; and an exhaust valve 18 which is adapted to be on/off controlled under a said pilot pressure that is derived from the air which is supplied via the said on and off valve 16 and the said electromagnetic valve 17 from the air reservoir 6 mentioned above. It should also be noted at this point that a conduit line referred to as reference numeral 19 serves to connect the said electromagnetic valve 18 and the said blocking valve 11 with the cushion cylinders 2 and 2 mentioned above.

Referring continuingly to FIG. 3, reference numeral 20 denotes a locking circuit for controlling the above mentioned locking cylinders 3, which circuit comprises a pair of locking valves 21 and 21, each for establishing and blocking a communication between an upper chamber 3*a* and a lower chamber 3*b* of each of the said locking cylinders 3 and 3, respectively; and a pair of electromagnetic valves 22 and 22 which are adapted to on/off control the pair of locking valves 21 and 21, respectively. At this point it should also be noted that the said electromagnetic valves 22 and 22 are configured to on/off control the said locking valves 21 and 21, respectively, by applying thereto a pilot pressure which is derived from air that is supplied out of an air reservoir 23.

An explanation will now be given with respect to an operation of the above mentioned first embodiment of the present invention.

First of all, when a start switch (not shown) is turned on in order to initiate operating a press machine, the said electromagnetic valve 17 of the above mentioned safety circuit 15 will be switched over from the said communicating position 17*b* to the said blocking position 17*c* and hence the said exhaust valve 18 will now be held under the action of a spring 18*c* at its blocking position 18*a*.

Also, since the above mentioned pad 1 lies at its upper limit position at the start of the pressing operation, the on and off valve 16 will be held at its closed state.

Next, upon the initiation of the press forming operation, as a forming thereby proceeds the said pad 1 will be lifted down to its lower limit position and then the said on and off valve 16 of the above mentioned safety circuit 15 will be opened by the above mentioned cam means 1*a* when the said pad 1 is brought into the vicinity of its lower limit position. At this instant, since the said electromagnetic valve 17 is in its blocking position 17*a*, the said exhaust valve 18 will be brought into its closed state so that the air within the said cushion cylinders 2 and 2 may not be exhausted.

Subsequently, when a slide (not shown) is lifted up, the said pad 1 will be temporarily locked by the said locking cylinders 3 and 3 as it lies in the vicinity of its lower limit position and thereafter will, as the said locking is released, be lifted up by the said cushion cylinders 2 and 2 to reach its upper limit position, whereupon the forming operation will be terminated.

On the other hand, if the power supply is turned off for a reason such as an interruption of service or a power failure during the above mentioned forming operation, the said electromagnetic valve 17 of the above mentioned safety circuit 15 will be rendered electrically non-conductive also and will then be switched over by the action of the said spring 17*c* to the said communicating state 17*b*.

At this instant, if the said pad 1 lies at its upper limit position, since the said on and off valve 16 of the above mentioned safety circuit 15 is then in its closed state, a pilot pressure will not be delivered to the said exhaust valve 18 even if the said electromagnetic valve 17 is brought into its communicating position 17*b*. For this reason, the said exhaust valve 18 will be held in its blocking position 18*a* so that the air within the said cushion cylinders 2 and 2 may not be discharged and, as a result, the said pad 1 may be kept stopped and may never be lowered.

Also, when the said pad 1 lies in the vicinity of its lower limit position, if the power supply is turned off for a reason such as an interruption of service or a power failure, since the said on and off valve 16 of the above mentioned safety circuit 15 is then switched over by the said cam member 1*a* to its communicating position 16*a* and the turn-off of the power supply then causes the said electromagnetic valve 17 to be switched over to its communicating state 17*b*, a pilot pressure will develop as the air is fed out of the said air reservoir 6 into the said exhaust valve 18 so that the latter may be switched over to its exhaust position 18*b*.

As a consequence, the said pad 1 will be stopped in the vicinity of its lower limit position and will never be lifted up. Especially, in a state in which the said pad 1 have been locked by the said locking cylinders 3 and 3 in the vicinity of its lower limit position, if the power supply is turned off for a reason such as an interruption of service or a power failure and thereafter the said locking cylinders 3 and 3 are released, the air will have already be discharged out of the said cushion cylinders 2 and 2 so that the said pad 1 may not be lifted up abruptly; hence the system is rendered safe.

Figure 4:
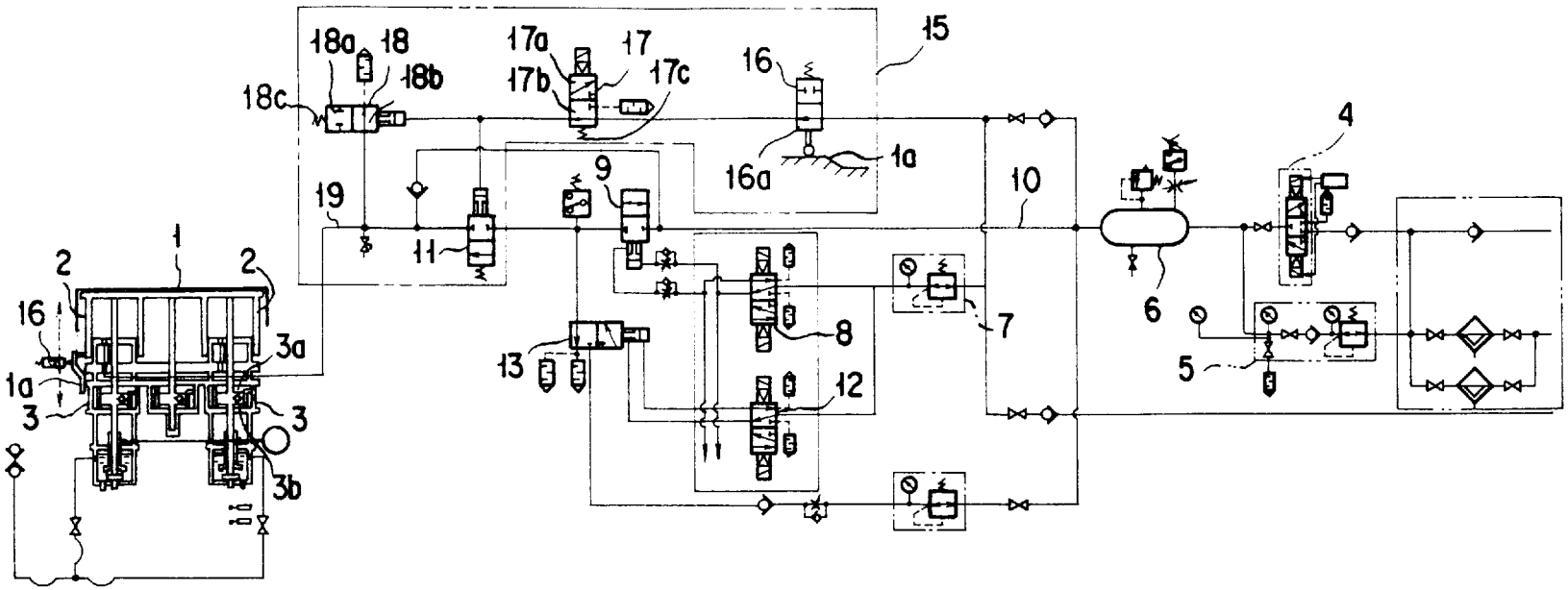
FIG. 4 is a circuit diagram of a second embodiment of the safety circuit for a press die cushion, that is constructed in accordance with the present invention.

It should also be noted at this point that while in the above mentioned first embodiment there are provided a pair of locking cylinders 3 and 3 for locking the said pad 1 in the vicinity of its lower limit position as well as a locking circuit 20 for controlling the said locking cylinders 3 and 3, the present invention is also applicable to a press die cushion in which the said locking cylinders 3 and 3 and the said locking circuit 20 are omitted as in a second embodiment as shown in FIG. 4.

It can be noted here that there are two types of press die cushions: one with an adjusting mechanism and one without any adjusting mechanism. A press die cushion with an adjusting mechanism is configured to have a number of cushion pins made constant in their length and also to adjust the upper limit position of a said pad 1 with the said adjusting mechanism in accordance with a depth to which a workpiece can be drawn. Then, the lower limit position of the said pad 1 is made commensurate with the locking position.

On the other hand, a press die cushion without such an adjusting mechanism is configured to adjust the upper position of a said pad 1 by changing the length of such a number of cushion pins in accordance with a depth to which a workpiece can be drawn. In this case, while the upper limit position of a said pad 1 is fixed, its lower limit position is made variable in accordance with the length of the said cushion pins.

Consequently, it cannot be discriminated whether or not a said pad 1 is in its locked state simply by a signal from a said on and off valve that is operable with a said cam means 1*a*.

Figure 5:
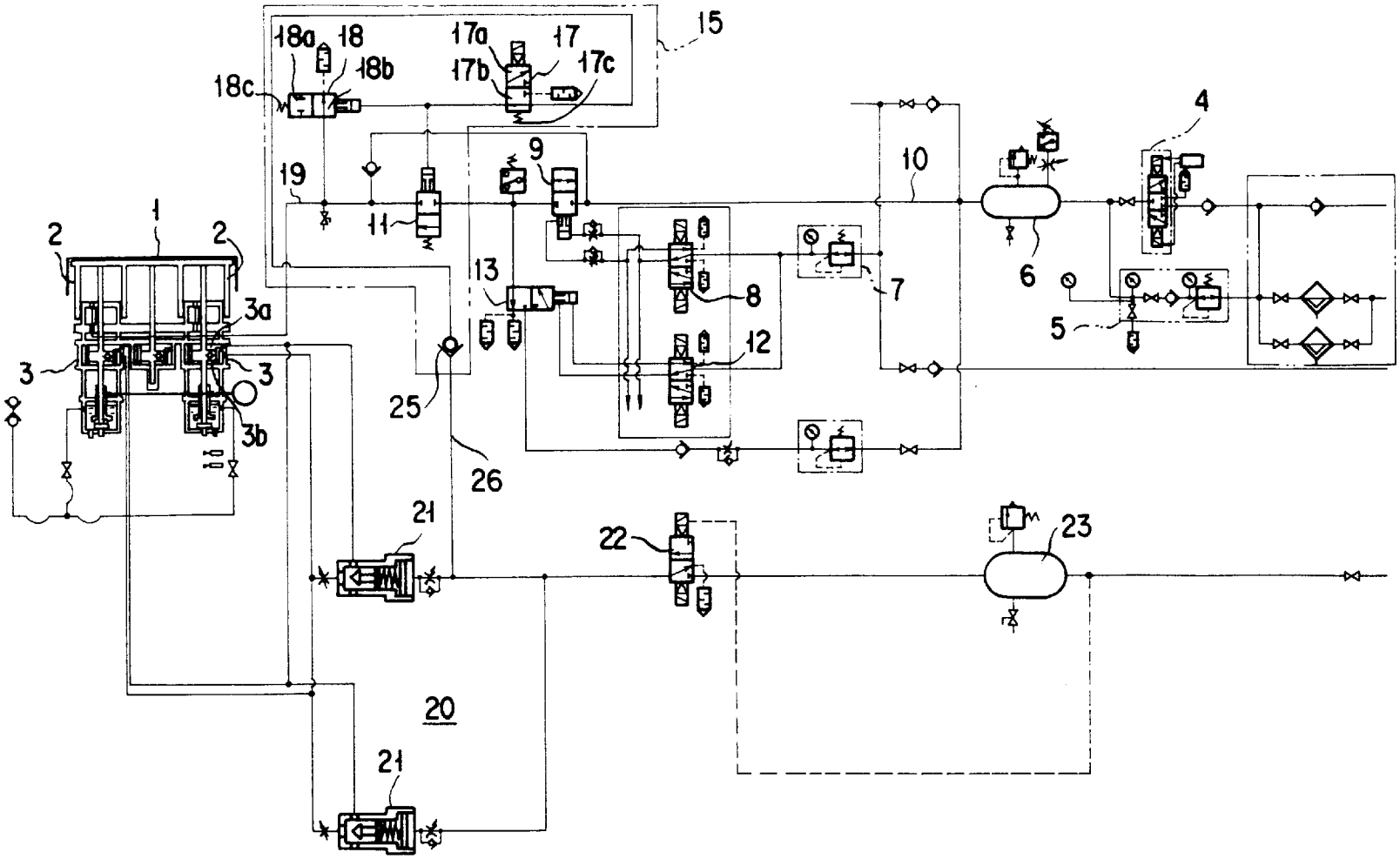
FIG. 5 is a circuit diagram of a third embodiment of the safety circuit for a press die cushion, that is constructed in accordance with the present invention.

In order to meet such a difficulty, there is provided a third embodiment of the present invention as shown in FIG. 5 in which a said locking circuit 20 and an upstream side of an electromagnetic valve 17 that is provided in a said safety circuit 15 are connected together by a conduit line 26 which is provided with a check valve 25 midway therealong.

According to such a modified configuration, it can be seen that if the power supply is turned off for a reason such as an interruption of service or a power failure during a locking period, since air is then supplied through the said locking circuit 20 to a said exhaust valve 18 to release the latter and also air is then discharged out of a said pair of cushion cylinders 2 and 2, a said pad 1 will be lifted down to its lower limit position and then to stop there and then will never be lifted up; hence the system is rendered safe.

This notwithstanding, however, in the above mentioned circuit shown in FIG. 5, it may be noted that in a state in which the said pad 1 lies in its upper limit position after a press forming operation is terminated, if the power supply is turned off and the air supply is turned off also, the said pad 1 lying in its upper limit position will be slowly lifted down due to a fluid leakage in the said cushion cylinders 2 and 2 or in any circuit and will thereafter be stopped at its lower limit position and then a danger will be brought about when the plant air supply on in order to initiate a press forming operation the next day. This will cause the said pad 1 to be rapidly lifted up contrary to the operator's intent and, as a consequence, if the operator is present within the press system 20, a danger will be imposed on the operator. More specifically, since a said electromagnetic valve 8 of both side SOL type allows a said air supply valve 9 to remain opened when the said pad 1 lies at its upper limit position and the pressure within the said conduit line 26 is then lowered due to an above mentioned fluid leakage and yet the said electromagnetic valve 17 that stands at its communicating position 17*a* causes the said exhaust valve 18 to lie in its blocking position 18*a* while causing a said blocking valve 11 to stand in its communicating position, if air is supplied through a said conduit line 10 from a said air reservoir 6, then the air will be quickly fed into the said cushion cylinders 2 and 2, thereby permitting the said pad 1 to be rapidly lifted up.

Figure 6:
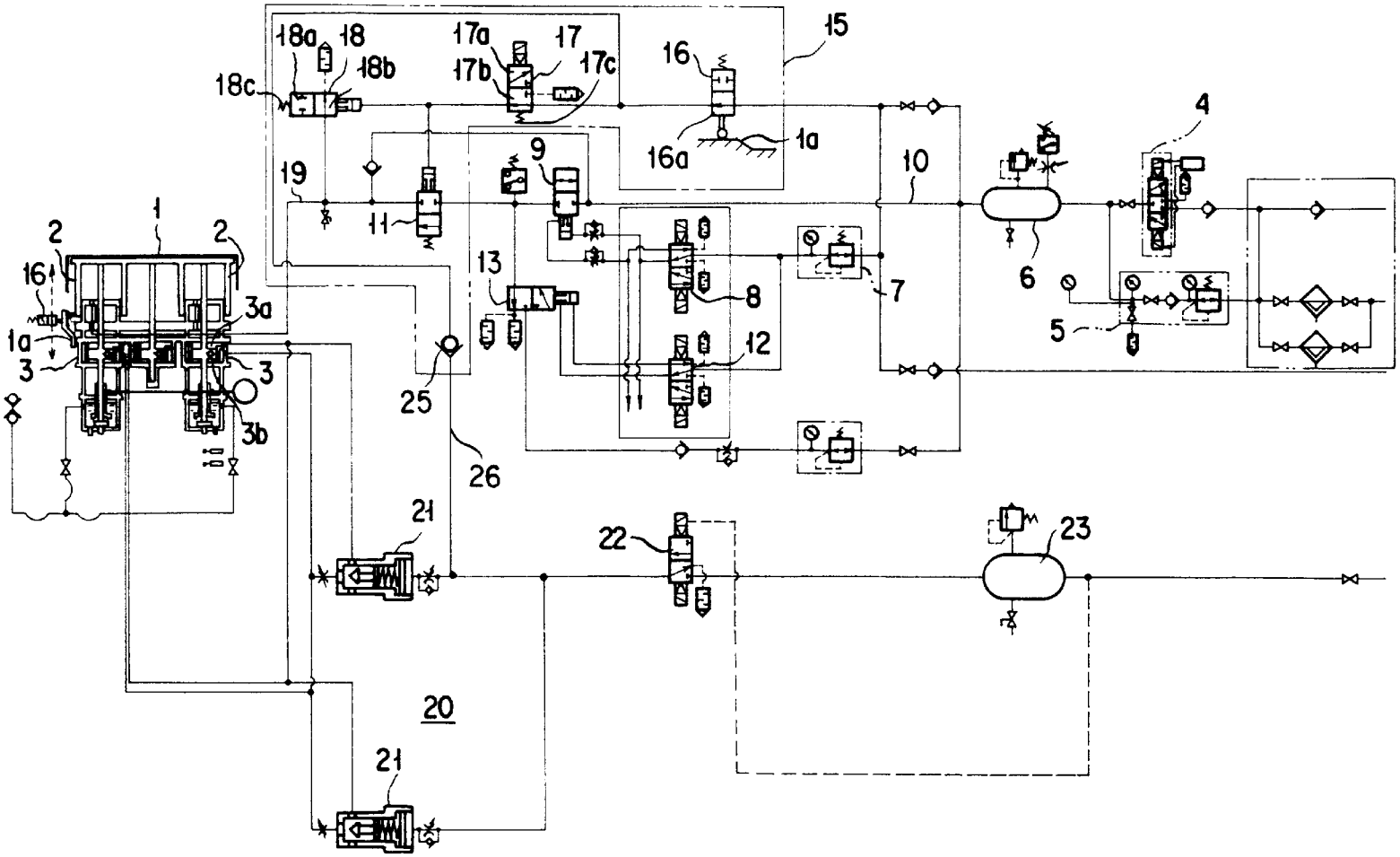
FIG. 6 is a circuit diagram of a third embodiment of the safety circuit for a press die cushion, that is constructed in accordance with the present invention.

Accordingly, there is provided a fourth embodiment of the present invention as shown in FIG. 6 in which a junction of a said on and off valve 16 and a said electromagnetic valve 17 on the one hand and a said locking circuit 20 on the other hand are connected together by a said conduit line 26 which is provided with a said check valve 25 midway therealong.

According this configuration, it can be seen that a said pad 1 which remains stopped at its lower limit position with the power supply turned off and the air supply also turned off will, if the air supply is turned on, cause air to be discharged out of a said air reservoir 6 and then fed via a said electromagnetic valve 17 into a said exhaust valve 18 and, since the said valve 18 is opened to discharge air out of said cushion cylinders 2, will cause the said pad 1 to remain stopped at its lower limit position and will never cause it to be lifted up; hence the system is rendered safe.

As set forth in the foregoing description, according to the present invention in which by using the electromagnetic valve of both side SOL type, the pad is made capable of being lifted up and down, it should be noted that if the power supply is turned off die to an occurrence of a power failure or an emergency stop during a pressing operation, the electromagnetic valve is allowed to remain in the state in which it had been and accordingly the pad is effectively prevented from being lifted up or down unintentionally; hence the system is rendered extremely safe.

Also, by virtue of the arrangement in which by providing an on and off valve that is adapted to be mechanically opened when the pad lies in the vicinity of its lower limit position, an electromagnetic valve of one side SOL type that is adapted to be blocked when the power supply is turned on and that is adapted to be brought into a communicating state when the power supply is turned off and an exhaust valve that is adapted to be switched into an exhaust side under a pilot pressure that is supplied via the said on and off valve and the said electromagnetic valve, at the time of a power failure or an emergency stop when the locking effected an air within the cushion cylinder is allowed to be exhausted, it should be noted if the air source is turned on when the locking is effected and when the power supply is on, the pad is effectively prevented from being lifted up and hence the system is rendered safe. Especially, even if the power supply and the air source are turned off at the same time, exhausting air out of the cushion cylinder will cause the pad to be lowered and stopped at its lower limit position and will prevent the pad from being lifted up. Accordingly, damage to a product, a workpiece suction attracting means or a cross bar that would otherwise occur due to the undesirable rise of the pad can be thereby prevented effectively.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A safety circuit for a press die cushion, said press die cushion having a pad that is resiliently supported by a cushion cylinder which is supplied with a pilot pressure via an air delivery circuit, and said press die cushion having a locking circuit for locking the pad, said safety circuit comprising:

a first electromagnetic valve which is electrically switchable in two directions for controlling delivery of the pilot pressure to an air supply valve in the air delivery circuit to the cushion cylinder, and for controlling the air supply valve in order to lift the pad up and down;

an on and off valve disposed in a pilot pressure delivery passage of the air delivery circuit, said on and off valve being opened when the pad lies in a vicinity of a lower limit position;

a second electromagnetic valve connected to the on and off valve, said second electromagnetic valve being electrically switchable in a first direction to a blocking position when a power supply is turned on, and said electromagnetic valve being mechanically switchable thereafter to a communicating position when the power supply is turned off; and an exhaust valve provided in the air delivery circuit, said exhaust valve being switched into an exhaust position when the pilot pressure is applied via the on and off valve and the second electromagnetic valve, and said exhaust valve being switched into a blocking position when the pilot pressure is absent.

2. A safety circuit for a press die cushion according to claim 1, further comprising a cam provided on a side surface of the pad, wherein the on and off valve is opened when the pad is brought to the vicinity of the lower limit position by the cam.

3. A safety circuit for a press die cushion, said press die cushion having a pad that is resiliently supported by a cushion cylinder which is supplied with a pilot pressure via an air delivery circuit, said safety circuit comprising:

a first electromagnetic valve which is electrically switchable in two directions for controlling delivery of the pilot pressure to an air supply valve in the air delivery circuit to the cushion cylinder, and for controlling the air supply valve in order to lift the pad up and down;

an on and off valve disposed in a pilot pressure delivery passage of the air delivery circuit, said on and off valve being opened when the pad lies in a vicinity of a lower limit position;

a second electromagnetic valve connected to the on and off valve, said second electromagnetic valve being electrically switchable in a first direction to a blocking position when a power supply is turned on, and said electromagnetic valve being mechanically switchable thereafter to a communicating position when the power supply is turned off; and an exhaust valve provided in the air delivery circuit, said exhaust valve being switched into an exhaust position when the pilot pressure is applied via the on and off valve and the second electromagnetic valve, and said exhaust valve being switched into a blocking position when the pilot pressure is absent.

4. A safety circuit for a press die cushion according to claim 3, further comprising a cam provided on a side surface of the pad, wherein the on and off valve is opened when the pad is brought to the vicinity of the lower limit position by the cam.

5. A safety circuit for a press die cushion, said press die cushion having a pad that is resiliently supported by a cushion cylinder which is supplied with a pilot pressure via an air delivery circuit, and said press die cushion having a locking circuit for locking the pad, said safety circuit comprising:

a first electromagnetic valve which is electrically switchable in two directions for controlling delivery of the pilot pressure to an air supply valve in the air delivery circuit to the cushion cylinder, and for controlling the air supply valve in order to lift the pad up and down;

a second electromagnetic valve which is electrically switchable in a first direction to a blocking position when a power supply is turned on, and which is mechanically switchable thereafter to a communicating position when the power supply is turned off;

an exhaust valve provided in the air delivery circuit, said exhaust valve being switched into an exhaust position when the pilot pressure is applied via the second electromagnetic valve, and said exhaust valve being switched into a blocking position when the pilot pressure is absent; and a check valve provided along a conduit line connecting an upstream side of the locking circuit and an upstream side of the second electromagnetic valve.

6. A safety circuit for a press die cushion according to claim 5, wherein said check valve is provided substantially midway along the conduit line.

7. A safety circuit for a press die cushion, said press die cushion having a pad that is resiliently supported by a cushion cylinder which is supplied with a pilot pressure via an air delivery circuit, and said press die cushion having a locking circuit for locking the pad, said safety circuit comprising:

a first electromagnetic valve which is electrically switchable in two directions for controlling delivery of the pilot pressure to an air supply valve in the air delivery circuit to the cushion cylinder, and for controlling the air supply valve in order to lift the pad up and down;

an on and off valve disposed in a pilot pressure delivery passage of the air delivery circuit, said on and off valve being opened when the pad lies in a vicinity of a lower limit position;

a second electromagnetic valve connected to the on and off valve, said second electromagnetic valve being electrically switchable in a first direction to a blocking position when a power supply is turned on, and said electromagnetic valve being mechanically switchable thereafter to a communicating position when the power supply is turned off;

an exhaust valve provided in the air delivery circuit, said exhaust valve being switched into an exhaust position when the pilot pressure is applied via the on and off valve and the second electromagnetic valve, and said exhaust valve being switched into a blocking position when the pilot pressure is absent; and a check valve provided along a conduit line connecting the locking circuit and a junction of the on and off valve and the second electromagnetic valve.

8. A safety circuit for a press die cushion according to claim 7, further comprising a cam provided on a side surface of the pad, wherein the on and off valve is opened when the pad is brought to the vicinity of the lower limit position by the cam.

9. A safety circuit for a press die cushion according to claim 7, wherein said check valve is provided substantially midway along the conduit line.

* * * * *